United States Patent [19]

Mills et al.

[11] Patent Number: 4,821,064

[45] Date of Patent: Apr. 11, 1989

[54] CONFORMABLE PAD SKIVE

[75] Inventors: Borden H. Mills, Webster; Lloyd E. Wade, Shortsville, both of N.Y.

[73] Assignee: Eastman Kodak Company, Rochester, N.Y.

[21] Appl. No.: 139,225

[22] Filed: Dec. 29, 1987

[51] Int. Cl.[4] ..... G03G 21/00; B65H 29/54

[52] U.S. Cl. ..... 355/3 FU; 271/313

[58] Field of Search ..... 355/3 FU, 3 SH, 3 R; 271/307, 311, 312, 313, 900

[56] References Cited

U.S. PATENT DOCUMENTS

| | | | |
|---|---|---|---|
| 3,938,950 | 2/1976 | Weiler et al. | 271/321 X |
| 4,065,120 | 12/1977 | Imaizumi et al. | 271/311 |
| 4,072,307 | 2/1978 | Knieser | 271/313 |
| 4,080,159 | 3/1978 | Behun | 432/60 |
| 4,244,648 | 1/1981 | Schultes et al. | 271/311 X |
| 4,336,992 | 6/1982 | Szlucha et al. | 355/3 FU |

FOREIGN PATENT DOCUMENTS

| | | | |
|---|---|---|---|
| 1583277 | 1/1981 | United Kingdom | 271/307 |

OTHER PUBLICATIONS

Xerox Disclos. Journal, vol. 1, No. 2, Feb. 1976, "Sheet Removal Device for Fuser Rolls".

*Primary Examiner*—Fred L. Braun

*Attorney, Agent, or Firm*—Tallam I. Nguti

[57] ABSTRACT

In an electrostatographic copier or printer, a skive with a base and a stripping edge is provided for removing copy sheets from the surface of a fuser roller that is coated with a resilient material such as rubber. The stripping edge of the skive is made from a hard material and the base of the skive which contacts and rides on the surface of the fuser roller is made from a soft material. Relative to the fuser roller coating, the hard material has a higher modulus of rigidity and the soft material has an equal or lower modulus of rigidity.

2 Claims, 1 Drawing Sheet

CONFORMABLE PAD SKIVE

This invention relates generally to the handling of copy sheets in an electrostatographic copier or printer, and more particularly to an improved skive for removing such sheets from the surface of the fuser roller.

In an electrostatographic copier or printer, desired images are first formed electrostatically on an image-bearing surface. The images so formed are next developed or made visible with loose fusable toner particles. The developed images are then transferred onto a selected receiver such as a copy sheet of paper. Thereafter, a finished image is obtained on the receiver by permanently fusing the toner particles onto the copy sheet, for example, by applying heat and pressure.

The heat and pressure method of fusing utilizes a pair of opposed rollers that form a nip. Fusing occurs when the copy sheet, carrying the loose toner particle images, passes through this nip. During such passage, the loose toner particles are simultaneously heat-softened and pressed permanently into the copy sheet.

The pair of rollers includes a fuser roller that is internally heated, for example, to supply the heat necessary to soften the toner particles, and a pressure roller that applies the necessary pressure at the nip to permanently fuse the particles into the copy sheet.

Usually, the copy sheet enters the nip with the front side, or the side carrying the image to be fused, directly facing, and in contact with the heated fuser roller. The pressure roller applies the necessary pressure to the back or other side of the copy sheet, thus pressing the copy sheet and the toner particles into the resilient coating of the fuser roller. Pressed in this manner, copy sheets occasionally will remain stuck to the fuser roller as the sheets pass out of the nip. Unless the copy sheet in such a case is stripped or removed from the fuser roller, it will doubtless cause a jam as the fuser and pressure rollers rotate to pick up the next copy sheet for fusing as described above.

Various methods and apparatus for stripping or removing copy sheets from the fuser roller are already well known in the art. One such method and apparatus involve the use of a mechanical blade or sharp edge against the surface of the fuser roller to pry the copy sheet free. Since the copy sheet to be pried is usually very thin, for example, only about 0.004 in. (4 mils) thick, this type of method is generally effective only if the apparatus has a very sharp and precise blade edge. Such an edge, however, is best made from a material that has a high modulus of rigidity or resistance to shearing stress, such as aluminum.

Because apparatus with these types of edges ride on and come into contact with the fuser roller, there is a tendency for them to wear out and to gouge the surface of the fuser roller. In addition, these types of apparatus are costly to operate because to remain effective over reasonable periods of use, they must be precisely set and reset against the surface of the fuser roller, and usually by a qualified technician.

SUMMARY OF THE INVENTION

It is therefore an object of the present invention to provide an improved skive for stripping copy sheets from the fuser roller in a copier or printer.

Another object of the present invention is to provide a skive that does not require precise setting and resetting to remain effective over reasonable periods of time.

A further object of the present invention is to provide a skive that rides on the fuser roller without gouging or significantly wearing out the surface of the fuser roller.

In accordance with the present invention, a skive for stripping copy sheets from the surface of the fuser roller of a copier or printer includes a stripping member that has a sharp edge for stripping the copy sheets. The stripping member is made from a hard material, that compared to the surface coating of the fuser roller, has a higher modulus of rigidity. The modulus of rigidity of a material as referred to here is a measure of the materials resistance to shearing stress at various angles of deformation. This is an important characteristic of the materials used in constructing a skive since shearing stresses are a major factor in the movement of the skive against the surface of the fuser roller.

A soft conformable pad that contacts and rides over the fuser roller surface, is connected to, and shimmed from the stripping member, thus separating such member and its sharp edge from the fuser roller surface. The pad is made from a material that has a modulus of rigidity that is equal to or lower than the modulus of rigidity of the surface coating of the fused roller. The shim like the stripping member and its sharp stripping edge, is made from a material that also compared to the surface coating of the fuser roller, has a higher modulus of rigidity. The sharp rigid edges of the stripping member, while spaced a short distance from the surface of the fuser roller, can effectively strip copy sheets from the fuser roller without gouging or significantly wearing out the surface of the fuser roller.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENT

The present invention will now be described with reference to its preferred embodiment as used at the fusing station of an electrostatographic copier or printer.

Figure 1:
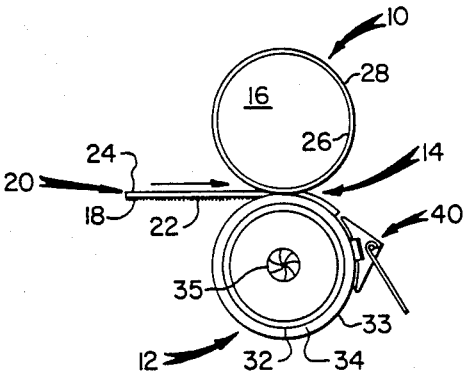
FIG. 1 is a view of a fusing station including the skive of the present invention.
Figure 2:
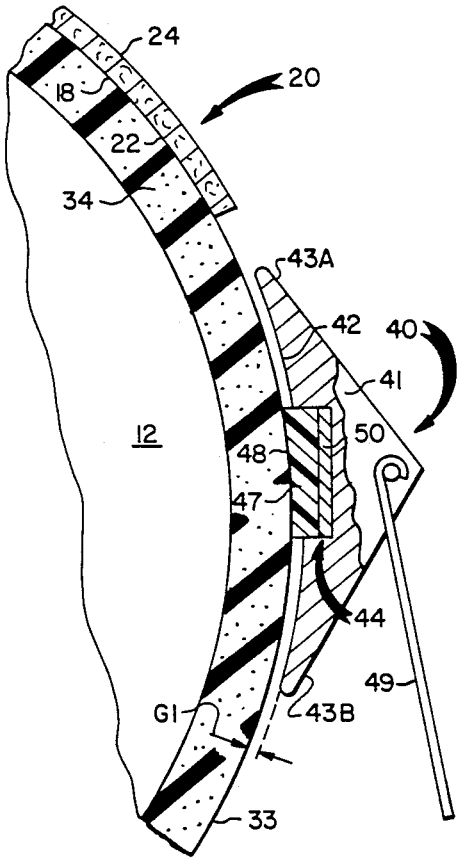
FIG. 2 is an enlarged view of the skive of the present invention in contact with a portion of the surface of the fuser roller.

Referring now to FIG. 1, a fusing station 10 includes a heated fuser roller 12 which forms a nip 14 with a pressure roller 16 for fusing loose toner images 18 carried by a copy sheet 20. The loose toner images 18 are carried on side 22 of the sheet 20 which enters the nip 14, facing and contacting the fuser roller 12, while side 24 of the sheet 20 faces and is in contact with the pressure roller 16.

The fuser roller 12 has a hollow cylindrical core 32 made of a heat-conductive material such as aluminum, and is coated with a resilient material 34 such as silicone rubber. The coating 34 has a smooth surface 33 against which the toner images 18 are directly heated and pressed for fusing into side 22 of copy sheet 20. Fuser roller 12 is heated either externally or internally. For example the roller 12 can be heated internally by a heat source 35 such as a quartz lamp. The pressure roller 16, on the other hand, has a steel cylindrical core 26 that is coated with a high temperature plastic 28. Roller 16 is movable, as by a cam (not shown) into and out of pressure engagement with the fuser roller 12. The rollers 12, 16, when in such pressure engagement, pick up and drive the sheet 20 through the nip 14 while heat-softening and pressing the toner images 18 and the sheet 20 into the surface 33 of roller 12. Occasionally, the sheet 20, when so pressed into the roller 12, will remain stuck to the surface 33 as the sheet 20 passes out of the nip 14.

In order to remove such a sheet 20 from the fuser roller 12, a skive of the present invention, generally designated as 40, is pivotably mounted on a flat spring 49 and urged by the spring into contact with the surface 33 for stripping such sheet 20 from the surface 33. The skive 40 includes an elongate stripping member 41. Member 41 is generally triangular in cross section and has an arcuate base 42 and two stripping edges 43A, 43B. When mounted, only one of the edges 43A, 43B is used for stripping. However, the symmetrical shape of the member 41 permits either edge to be mounted for stripping sheets. Thus edge 43A is illustrated as the stripping edge but the skive 40 can also be mounted so that the edge 43B is the stripping edge. The stripping member 41 and hence the edges 43A, 43B preferably are spaced a distance G1 that is equal to .001 inch from the surface 33 of roller 12.

The member 41 can be made of a hard material such as aluminum, or other such material, that relative to the resilient (rubber) coating 34 of the fuser roller 12, has a higher modulus of rigidity. The modulus of rigidity of a material as referred to here is a measure of the materials resistance to shearing stress at various angles of deformation. This is an important characteristic of the materials used on constructing a skive since shearing stresses are a major factor in the movement of the skive against the surface of the fuser roller. The edges 43A, 43B, however, are preferably made from such material in order to be able to provide a sharp edge, e.g., an edge with a diameter D1 (FIG. 3) of about 0.002 inch (2 mils).

The base 42 of member 41 has a radius of curvature substantially equal to that of roller 12 and so can fit closely over the surface 33 if allowed to lie directly thereon. A groove 44 runs the length of the base 42 and is located in the surface of the base 42 facing surface 33. The groove is centered between the edges 43A, 43B, and preferably is at least as wide as one-third to one-half the width of the base 42.

A pad 47 having the same dimensions as the groove 44 is positioned in the groove. The pad including a bottom portion 48 that contacts the fuser roller 12 and has a radius of curvature substantially equal to that of the fuser roller 12. The pad 47 is made from a soft, conformable material such as an elastomer, or other such material that relative to the resilient (rubber) coating 34 of the fuser roller 12 , has an equal or lower modulus of rigidity. The pad 47 after being positioned in the groove 44 is machined as an assembly with the base 42 so that the surface of the base 42 and that of the bottom portion 48 are essentially coplanar. Because the pad 47 is conformable, all of its bottom portion 48 actually contacts the surface 33 of the fuser roller 12, thus substantially reducing the contact pressure of the entire skive 40 on the surface 33.

A shim 50 as long and as wide as the groove 44 is inserted in the groove 44 between the member 41 and pad 47. This insertion of the shim 50 causes the pad 47 to protrude by a distance G1, equal to .001 inch, from the base 42. With the bottom portion 48 of the pad 47 contacting and riding over the surface 33, the 0.001 inch protrusion of the pad 47 from the base 42 results in a 0.001 inch spacing of the member 41 and hence of edges 43A, 43B from the surface 33. Shim 50 can be cemented or otherwise secured to member 41 and pad 47. Because pad 47 itself has the same dimensions as groove 44, the pad projects from the groove by a distance G1 equal to the thickness of the shim. Thus if shim 50 is 0.001 inch thick, for example, the portion 48 of pad 47 in contact with surface 33 projects 0.001 inch from base 42. Bottom portion 48 of the pad is large enough to hold base 42 of member 41 in a stable position relative to surface 33. Thus base 42 and its edges 43A, 43B are spaced from surface 33 by distance G1, or 0.001 inch in the specific example of the thickness of the shim set forth above. As such, the skive 40 can ride over the surface 33 with only the bottom portion 48 of pad 47 contacting the surface 33.

Figure 3:
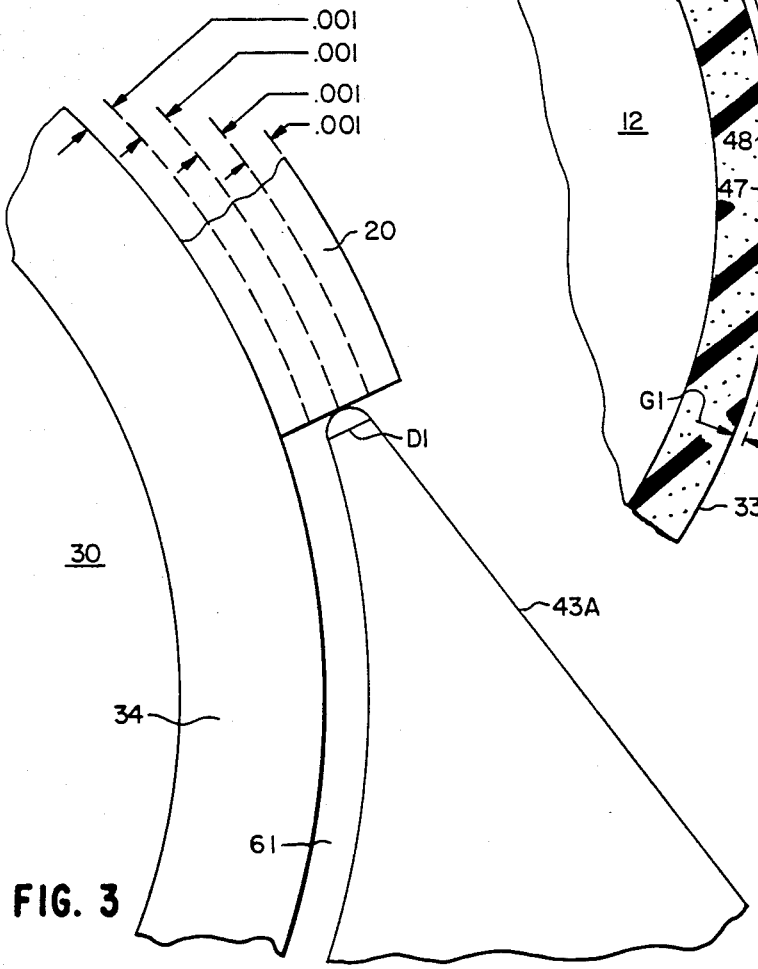
FIG. 3 is an enlarged view of a stripping edge of the skive in contact with the leading edge of a copy sheet on the surface of the fuser roller.

As is shown in FIG. 3, and based on the specific dimensions set forth above, the center of edge 43A, with a diameter D1 of 0.002 inch and a spacing of 0.001 inch from the surface 33, contacts a copy sheet 20 of 0.004 inch thickness at a point 0.002 inch from the surface 33. At this distance (0.002 inch) from the surface 33, the edge 43A can strip away from surface 33 any copy sheet 20 of about 0.004 inch thickness that adheres to surface 33.

Operatively, the pressure roller 16 and fuser roller 12 while rotating oppositely in nip engagement 14, will pick up and pass a copy sheet 20 carrying toner images 18 through the nip 14. During such passage, the fuser roller 12, heated by the heat source 35, will heat-soften the toner particles that form the toner images 18, while the pressure roller 16 simultaneously presses the heat-softened particles into the copy sheet 20. Should the copy sheet 20 stick to the surface 33 of the fuser roller 12, as occasionally happens, the edge 43A, spaced about 0.001 inch from surface 33, will contact and strip such copy sheet therefrom. The shim 50 establishes the correct spacing of the edge 43A from surface 33 thereby preventing the sharp and rigid edge 43A from gouging and wearing out the surface 33. The 0.001 inch protrusion G1 of pad 47 between the edge 43A and surface 33 also insures the continued effectiveness of the skive of the present invention over reasonable periods of time. Over such periods, any wear in the bottom portion 48 of the pad 47, actually increases stripping effectiveness by reducing the spacing G1 of edge 43A from surface 33.

As is clear from the above description, the present invention provides in a copier or printer, an improved skive for stripping copy sheets from the surface of the fuser roller. Only the soft conformable pad portion of the skive contacts and rides over the surface of the fuser roller thus minimizing contact pressure between the surfaces and also substantially preventing any damage to the surface of the fuser roller by edge 43A. The rigid stripping edge is sharp and precise, and because it is spaced precisely from the surface of the fuser roller by the shim behind the pad, no precise setting or resetting of the skive is required in order to maintain its continued effectiveness over reasonable periods of time. Spring 49 continually urges the member 41 toward surface 33, but member 41 can move away from surface 33 and against the force of the spring in the event the member encounters excessively high forces. Member 41 also can pivot about its connection to the spring so that it is self-aligning against the roller surface 33.

Although the present invention has been described in detail with particular reference to a preferred embodiment, it will be understood that variations and modifications can be effected within its spirit and scope.

What is claimed is:

1. An apparatus in a copier or printer for stripping copy sheets from the surface of a fuser roller that is coated with a resilient material such as silicone rubber, the apparatus comprising:

(a) a solid, generally triangular stripping member having a base and a first stripping edge, said stripping member consisting of a hard material that, relative to the surface material of the fuser roller has a higher modulus of rigidity, said base having a radius of curvature substantially equal to the radius of curvature of the fuser roller and said base further having a groove therein;

(b) means for pivotably supporting and urging said stripping member against the surface of the fuser roller;

(c) a thick conformable pad positioned in said groove and having an outer surface for contacting the surface of the fuser roller, said pad having substantially the same dimensions as said groove including a bottom portion with a radius of curvature substantially equal to the radius of curvature of the fuser roller, and said pad further consisting of a soft material that, relative to the surface material of the fuser roller has an equal or lower modulus of rigidity; and (d) a shim with a length and width substantially equal to that of said groove, the shim being positioned in said groove between said stripping member and said pad for causing said pad to protrude from said base of said stripping member by a distance substantially equivalent to said thickness of said shim, and for spacing said stripping edge from the surface of the fuser roller.

2. The invention as set forth in claim 1, wherein said stripping member has a second stripping edge, and wherein said second edge and said first edge are symmetric about said groove in said base of said stripping member so that said stripping member can be mounted with either of said edges positioned to be engaged with a copy sheet on the fuser roller.

* * * * *